US006349520B2

(12) United States Patent
Kubica

(10) Patent No.: US 6,349,520 B2
(45) Date of Patent: Feb. 26, 2002

(54) INSULATED CONCRETE WALL SYSTEM

(75) Inventor: Richard Kubica, Traverse City, MI (US)

(73) Assignee: K-Wall Poured Walls, Inc., Traverse City, MI (US)

( * ) Notice: Subject to any disclaimer, the term of this patent is extended or adjusted under 35 U.S.C. 154(b) by 0 days.

(21) Appl. No.: 09/754,923

(22) Filed: Jan. 5, 2001

Related U.S. Application Data

(62) Division of application No. 09/363,682, filed on Jul. 29, 1999

(60) Provisional application No. 60/116,177, filed on Jan. 18, 1999, and provisional application No. 60/119,974, filed on Feb. 12, 1999.

(51) Int. Cl.[7] ..... E04B 2/18

(52) U.S. Cl. ..... 52/426; 52/425; 52/564; 52/565

(58) Field of Search ..... 52/426, 564, 565, 52/425, 562

(56) References Cited

U.S. PATENT DOCUMENTS 3,238,684 A * 3/1966 Wood ..... 52/425
3,676,967 A * 7/1972 Frati ..... 52/426
3,902,296 A * 9/1975 Thomas ..... 52/747
4,433,520 A * 2/1984 Maschhoff ..... 52/275
4,604,843 A * 8/1986 Ott et al. ..... 52/426
4,750,308 A * 6/1988 McKay ..... 52/379
4,841,707 A * 6/1989 Novoa ..... 52/426
4,938,449 A * 7/1990 Boeshart ..... 249/216
5,040,344 A * 8/1991 Durand ..... 52/127.2
5,625,989 A * 5/1997 Brubaker et al. ..... 52/309.12
5,852,907 A * 12/1998 Tobin et al. ..... 52/714
6,250,033 B1 * 6/2001 Zelinsky ..... 52/275

* cited by examiner

*Primary Examiner*—Carl D. Friedman
*Assistant Examiner*—Phi Dieu Tran A

(57) ABSTRACT

An insulated concrete wall structure having a concrete wall with opposing wall surfaces. The concrete wall has several vertically and horizontally spaced wall ties imbedded within the concrete wall and extending between the wall surfaces. Positioned between the vertically spaced wall ties are a series of elongated retaining strips such that the retaining strips are substantially parallel to the wall surface. Insulating panels such as polystyrene foam boards are located between the horizontally spaced wall ties and retained in position by the retaining strips. In one aspect of the invention, each insulating panel has a groove formed along its vertical edge for receiving and engaging the elongated edge of the retaining strips. The present wall system is advantageous in that an insulated concrete wall can be readily formed using conventional wall forms in approximately the same amount of time as conventional uninsulated poured concrete walls.

12 Claims, 3 Drawing Sheets

INSULATED CONCRETE WALL SYSTEM

CROSS-REFERENCE TO RELATED APPLICATION

This application is a divisional of copending application No. 09/363,682 filed on Jul. 29, 1999. The nonprovisional application designated above, namely application 09/363,682, filed Jul. 29, 1999, claims the benefit of U.S. Provisional Applications Nos. 60/116,177 filed on Jan. 18, 1999 and 60/119,974 filed on Feb. 12, 1999.

BACKGROUND

This invention relates generally to poured concrete wall systems and, more particularly, concerns a method and apparatus for forming insulated concrete walls.

Concrete walls can be formed in various ways. Some are constructed from concrete blocks on footings, some can be made from prefabricated members, and others can be formed by pouring or pumping in uncured concrete between rigid forms. The wall forms are generally planar structures and typically are made of wood, aluminum, steel, or combinations of these materials. For poured walls, two series of coplanar wall forms are held in a spaced-apart, generally parallel relationship to create the cavity which will form the concrete wall. The wall forms are typically held in the correct spaced-apart relationship by a series of retaining ties extending between the form assemblies. The retaining ties commonly include holes formed in each end whereby pins are used to join adjacent coplanar forms together. Once the wall forms are in place, concrete is poured into the cavity between the forms and, after the concrete has cured, the forms are disassembled for reuse. The protruding ends of the ties are then broken off.

Poured concrete walls have many benefits over other types of concrete walls. They can be quickly constructed, are relatively easy to construct, are versatile, and durable. One drawback of all concrete walls however, is that they are poor insulators. A typical concrete wall has an insulating "R" value of approximately 1.0.

To improve the insulating qualities of concrete walls, several methods have been developed for incorporating polystyrene sheets within the concrete wall, or on one or both exterior surfaces of the concrete wall. A concrete wall with 2.5 inches of polystyrene insulation on one side has an insulating "R" value of approximately 13.0. Similarly, a concrete wall with 2.5 inches of polystyrene insulation on both exterior surfaces of the wall has an insulating "R" value of approximately 26.0.

Present methods of insulating concrete walls, however, suffer from the drawback of adding considerable time and labor to construct the concrete wall. One known method in particular uses special parallel foam sheets held together by metal members. This system is difficult and time consuming to set up, and requires additional external supports to prevent the foam walls from bulging due to the weight of the concrete. Another drawback of some insulated concrete wall systems is that they require unique and unconventional wall forms. This also can add additional time, labor and, ultimately, cost to the finished concrete wall.

SUMMARY OF THE INVENTION

Accordingly, it is an object of the present invention to provide an improved insulated concrete wall system and method. It is another object of the present invention to provide an insulated concrete wall system using conventional wall forms.

Another object of the present invention is to provide an insulated concrete wall having an exterior surface which readily accepts fasteners in order to attach additional materials to the wall.

According to the present invention, the foregoing and other objects and advantages are attained by an insulated concrete wall structure having a concrete wall with opposing wall surfaces. The concrete wall has several vertically and horizontally spaced wall ties imbedded within it. Positioned between the vertically spaced wall ties are a series of elongated retaining strips such that the retaining strips are substantially parallel to the wall surface. Insulating panels such as polystyrene foam boards are located between the horizontally spaced wall ties and retained in position by the retaining strips. In one aspect of the invention, each insulating panel has a groove formed along its vertical edge for receiving and engaging the elongated edge of the retaining strips.

An advantage of the present invention is that an insulated concrete wall can be readily formed using conventional wall forms in approximately the same amount of time as conventional uninsulated poured concrete walls. The present invention also provides and insulated poured concrete wall which is less expensive than known insulated concrete wall systems.

Other objects and advantages of the invention will become apparent upon reading the following detailed description and dependent claims, an upon reference to the accompanying drawings.

BRIEF DESCRIPTION OF THE DRAWINGS

For more complete understanding of this invention, reference should now be had to the embodiments illustrated in greater detail in the accompanying drawings and described below by way of examples of the invention. In the drawings.

DESCRIPTION OF THE PREFERRED EMBODIMENT

Figure 1:
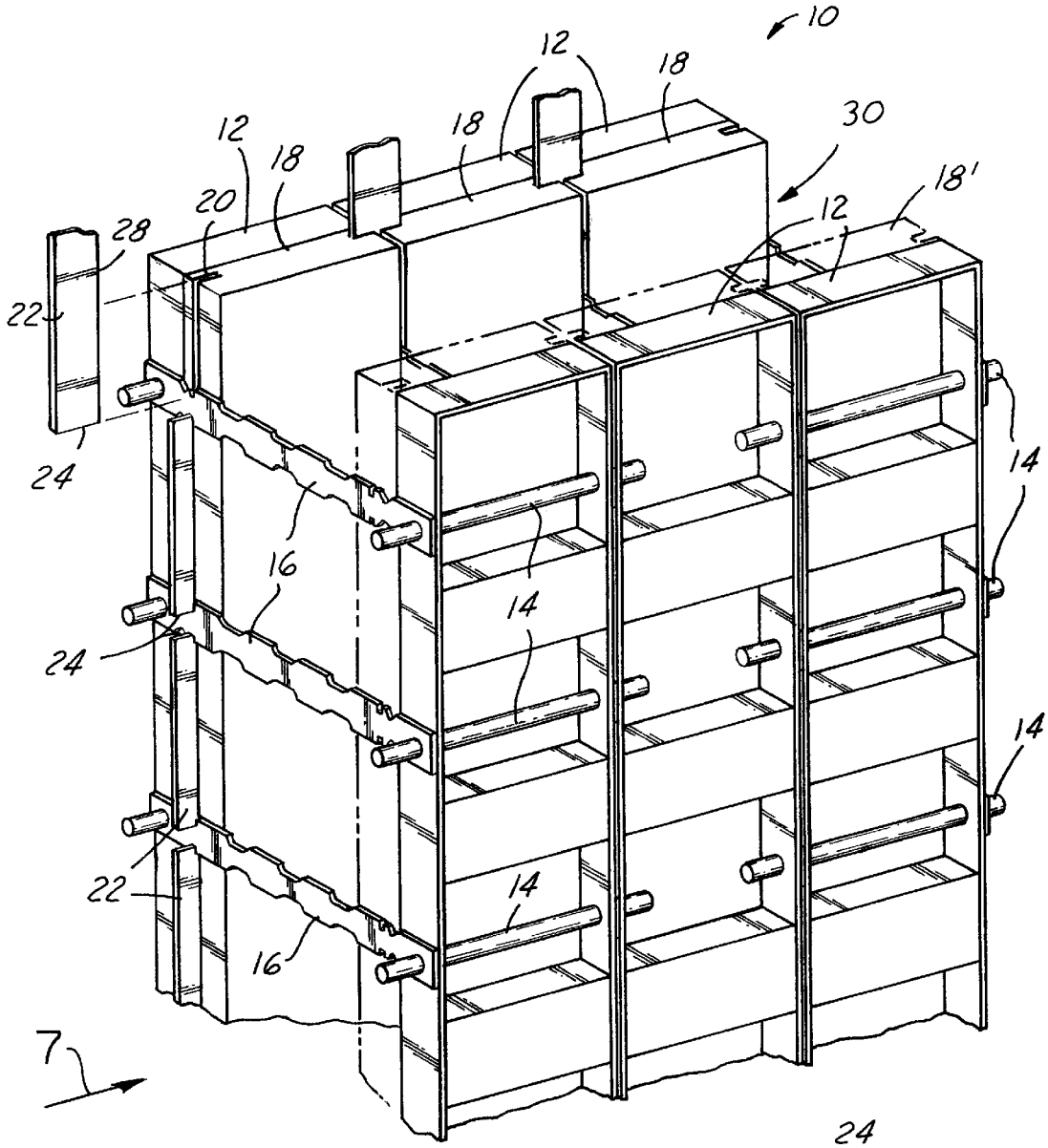
FIG. 1 is a perspective view of an insulated concrete wall system according to one embodiment of the present invention.

Referring to FIG. 1, there is shown a perspective view of a portion of a wall forming system 10 in accordance with one embodiment of the present invention. The system 10 includes a plurality of concrete wall forms 12. Adjacent wall forms 12 are held in a coplanar relationship by connecting pins 14. The two series of coplanar wall forms 12 are held in an opposing spaced apart, parallel relationship by a plurality of wall ties 16. Connecting pins 14 pass through each end of the wall ties 16 to maintain the spaced apart parallel relationship of each series of coplanar wall forms 12. Wall forms 12 are conventional and can be constructed of wood, aluminum, iron, steel, or a combination of these materials. Typically, the wall forms 12 are constructed of aluminum.

The metal forms 12 are typically 2–6 feet wide and 4–8 feet high, although they can be provided of any increment of width and height. Connecting pins 14, which may be of the spring-actuated connecting rod type, are used to hold adjacent form members together to form one side of the wall. Once in position, the spaced-apart wall forms 12 form a cavity for receiving uncured concrete.

Insulating panels 18 are positioned adjacent to interior surfaces along one of the row of wall forms 12. Preferably, the insulated panel 18 includes grooves 20 formed in opposing vertical edges of the insulating panel 18. The groove 20 engages an elongated edge 28 of the retaining strips 22. Preferably, the ends 24 of the retaining strips 22 are secured to the wall ties 16 by notches 26 formed in the wall ties.

In operation, once the wall forms 12 are assembled with the connecting pins 14 and wall ties 16, a plurality of insulating panels 18 and retaining strips 22 are positioned inside the wall forms 12 and along one wall surface. The strips 22 are placed between the vertically spaced-apart wall ties 16 and held in place by the notches 26 and the grooves 20 in the form panels 18. The insulating panels 18 are secured in place by the retaining strips 22. Since the retaining strips 22 engage the insulating panel 18, the location of the retaining strips 22 dictate the location of the insulating panels. Accordingly, the notches 26 are preferably located such that the insulating panel 18 is maintained adjacent one of the interior wall surfaces. In this way, a cavity 30 remains between the insulating panel 18 and the opposing parallel spaced apart wall form 12 while the adjacent wall form 12 provides additional support for the insulating panel 18.

The insulating panels 18 can be made of any insulating material which has some structure, but preferably are made of a polystyrene foam material. The panels 18 are preferably provided in similar sizes and shapes as the sections of wall forms. Thus, the panels 18 can be 2–6 feet in width and 4–8 feet in height, but can be provided of any incremental width and height. The panels 18 also can have any desired thickness, with the thicker materials having a greater insulating "R" value. Typically, the panels 18 are 2–3 inches in thickness.

The retainer strips 22 can be made of any material, such as wood, plastic or metal. The strips are relatively thin—on the order of one-eighth inch in thickness—and about 1–4 inches wide. The width of the strips is correlated to the depth of the grooves 20 in the insulating panels 18, since each strip 22 is positioned between two abutting panels 18. The height or length of the retraining strips 22 is dependent upon the distance between adjacent ties 16, but typically are about one foot in length. The retaining strips also should be made of a material to which conventional fasteners, such as screws and nails, can be secured.

To create the wall, uncured concrete is poured into the cavity 30. In this regard, the term "poured" is to be taken to include any method or manner in which concrete can be inserted into the cavity 30, whether by hand, from a concrete truck chute, from a pumping system, etc. Once the concrete is set (typically 12–24 hours), the forms 12 are removed by releasing the connecting pins 14 from the holes 32 of the wall ties 16. The forms 12 are then pulled away from the concrete wall. Once the pins and forms are removed, the concrete wall remains with the wall ties 16 imbedded within, and insulating panel 18 bonded to one side thereof. A portion of the wall ties 16 will remain extending out of the wall surface as well as the face of the insulating panel 18. These end portions are broken or snapped off as described below with reference to FIG. 8.

Figure 7:
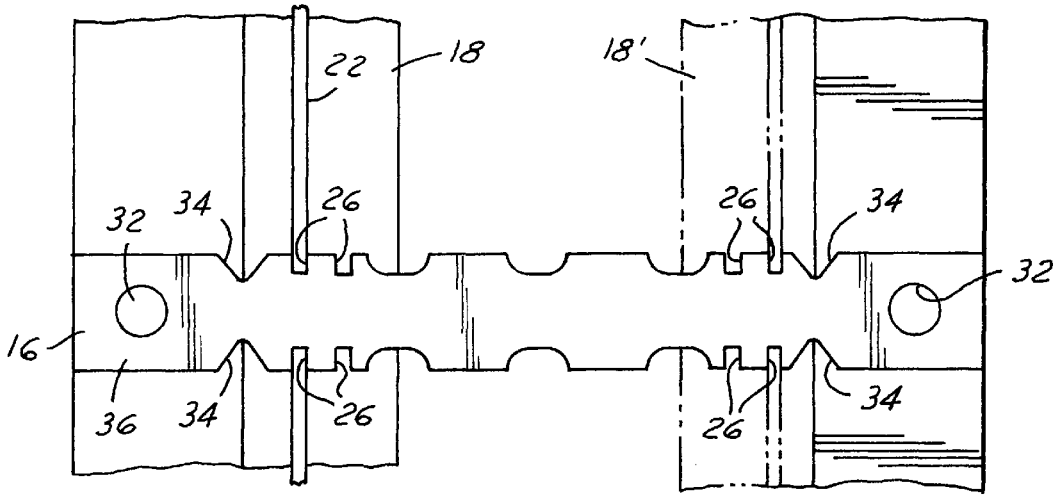
FIG. 7 is a side view of the insulated wall system as shown in FIG. 1.

Although the wall structure of FIG. 1 is shown with only one insulating panel, a second insulating panel can similarly be installed adjacent the opposing wall form 12. This is shown by phantom line 18' in FIGS. 1 and 7. In such a configuration, the finished concrete wall would have both exterior surfaces covered by insulating panels 18 and 18'. Also, if only one insulating surface is provided, it typically is situated on the concrete wall so it faces the interior of the building. In this manner, the wall can be finished over the insulation in a conventional manner.

Figure 2:
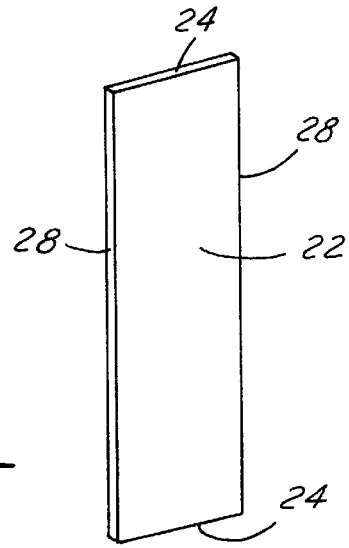
FIG. 2 is a perspective view of a retaining strip for use in the wall system of FIG. 1.
Figure 3:
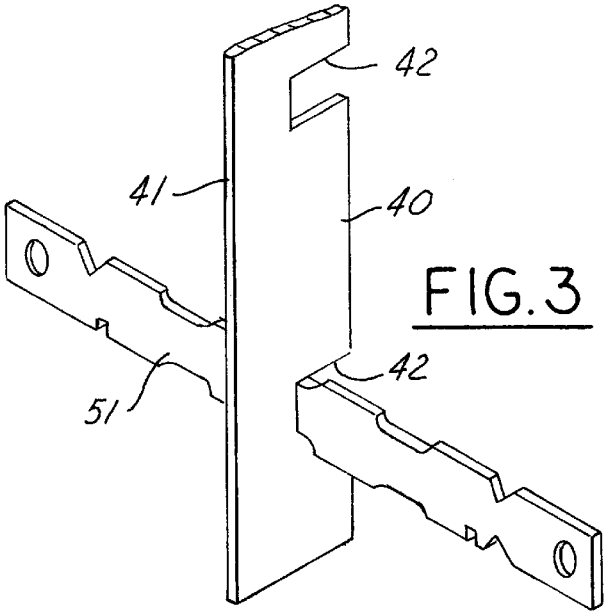
FIGS. 3, 4 and 5 are alternative embodiments of retaining strips which can be used in the wall form system of FIG. 1.
Figure 4:
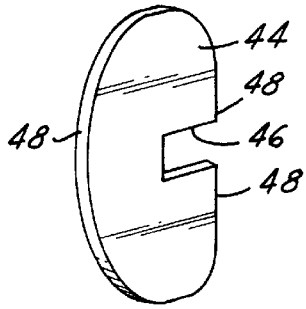

FIGS. 2, 3, and 4 show different embodiments for the retaining strip 22 of the wall system of FIG. 1. The retaining strip 22 as shown in FIG. 2 is configured to be positioned between the wall ties 16 with the ends 24 engaging the notches 26 of their respective vertically spaced wall tie 16. The elongated edge 28 maintains the insulating panel 18 (FIG. 1) in place by engaging the groove 20 of insulating panel 18. The retaining strips 22 are preferably constructed of wood or plastic, or any other building material which would accommodate screws, nails or other fasteners.

In this way, the retaining strips 22 also serve the function as a fastening device for siding or drywall, for example, to be attached to the finished concrete wall.

FIG. 3 shows an alternative embodiment for the retaining strips. The retaining strip 40 includes cutout portions 42 which are formed to fit over the wall tie 16 rather than between the wall ties 16. The retaining strip 40 can include several of the cutout portions 42 and can be equal to or greater in length than the height of insulating panel 18 and wall form 12.

FIG. 4 shows another embodiment for the retaining strips. In this case, the retaining strip 44 includes one or more cutout portions 46 to again fit around the wall ties 16 rather than between the wall ties 16. The retaining strip 44 differs from that of FIG. 3 in that it includes curved elongated edges 48 which engage the groove 20 of the insulating panel 18 and aid in sliding the insulating panel 18 in place as shown in FIG. 1.

Figure 5:
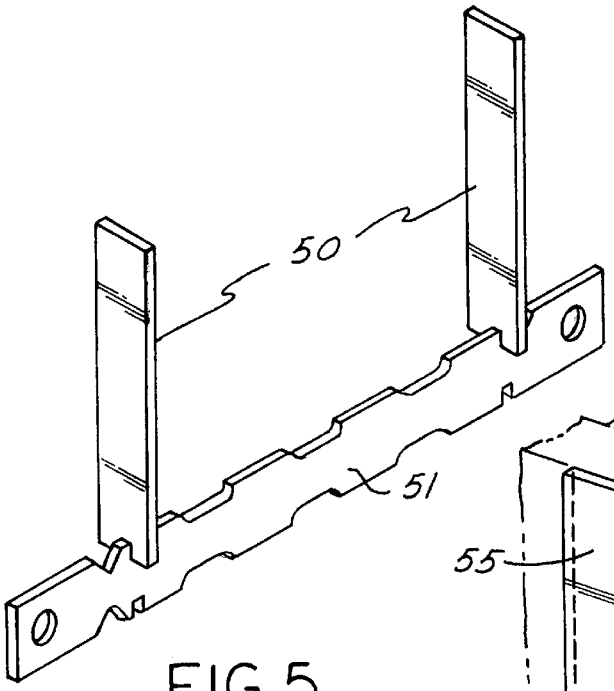

FIG. 5 shows another alternative embodiment wherein the retaining strips 50 and wall ties 51 are provided as a one-piece member.

Furthermore, as shown in FIGS. 2, 3 and 4, the elongated edges 28, 41 and 48 of retaining strips 22, 40 and 44, respectively, can be chamfered or beveled to aid in engaging grooves 20 of insulating panels 18. Likewise, as shown in FIG. 1, grooves 20 can be chamfered or beveled to aid in engaging the elongated edges of retaining strips 22, 40 or 44.

Figure 6:
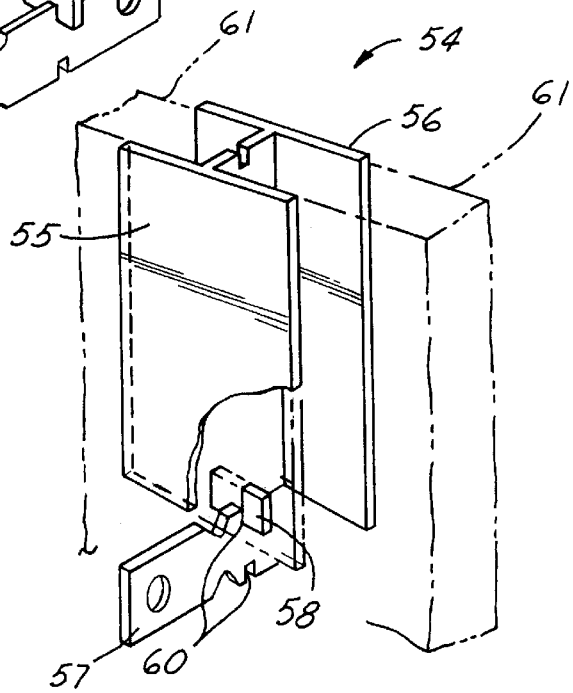
FIG. 6 is an alternative arrangement for the wall tie and retaining strips for use in the wall system of FIG. 1.

FIG. 6 shows another embodiment for the wall tie and retaining strips for use in the present wall form system. As shown in FIG. 6, the retaining strip 54 can be "H"-shaped whereby an insulating panel 61 can be held between the two upstanding members 55, 56. In this way, the groove 20 (FIG. 1) would not have to be formed in the insulating panel 61. The retaining strip engages the wall tie 57 by raised portion 58 which could be formed as part of the wall tie 57 or retaining strip 54, or a separate piece placed in the notch 60 of the wall tie 57.

Figure 8:
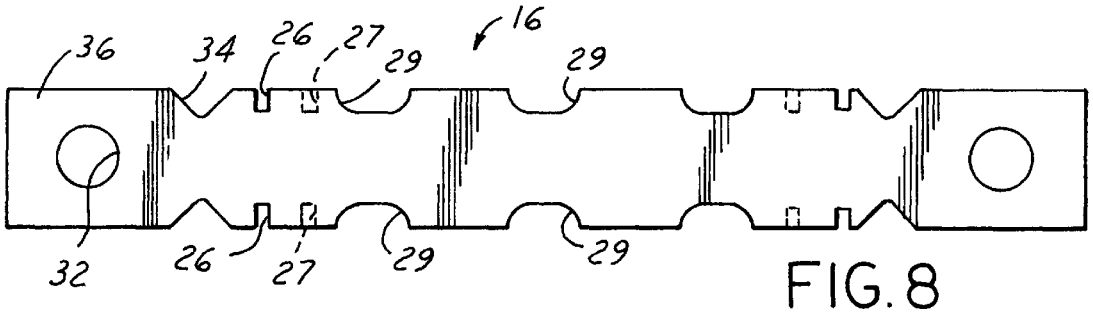
FIG. 8 is a plan view of a preferred wall tie for use with the present invention.

Referring to FIG. 8, the preferred form of wall tie 16 is shown. The tie has breakaway V-notches 34 formed near each end to allow that portion of the wall tie 16 which extends beyond the planar surface of the concrete wall to be readily broken away or snapped off. Breakaway V-notches 34 are preferably formed at a location in the wall tie 16 such that, after breaking off the end portion 36, the remaining ends of the wall ties 16 lie below the exterior wall surface. In this way, the finished wall surface will be void of any protrusions, and ready to receive, for example, drywall or paneling. If desired, several sets of pairs of notches 26 could be provided in the wall ties 16 in order to accommodate insulating panels of different thickness. These additional notches are shown as phantom notches 27.

The wall ties 16 also have holes or openings 32 at each end for receiving the connecting pins 14. The ties 16 further have a plurality of recesses 29 which are used to locate and position reinforcing rods in the concrete wall, if they are utilized in the construction process. Also, as can be seen in FIG. 8, the wall ties 16 are symmetrical at each edge and end so that they will always be positioned properly in the construction process.

Figure 9:
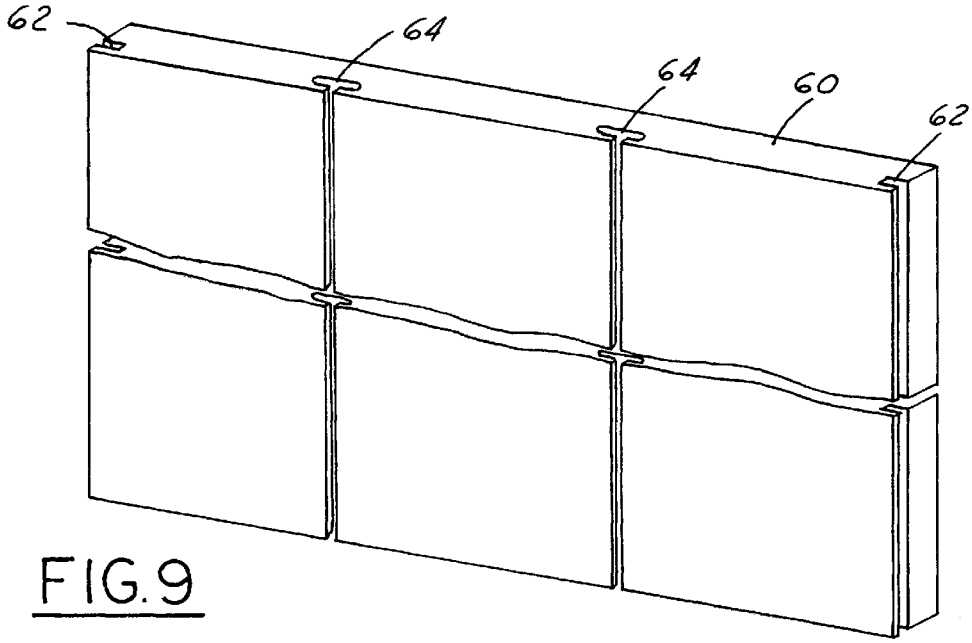
FIG. 9 is a plan view of an alternative embodiment for the insulating wall panel for use in the wall system of FIG. 1.

FIG. 9 shows an alternative embodiment for the insulating panels used in the present wall system. The insulating panel 60 includes grooves 62 along the elongated edges thereof for engaging the retaining strips and holding the panel 60 in place against one surface of wall forms. The panel further includes recesses 64 formed parallel to and adjacent one face of the panel 60. Recesses 64 engage additional retaining strips to allow building materials such as drywall or paneling to be attached to the face of the panel 60 once the wall forms are removed and the wall completed.

From the foregoing, it will be seen that there has been brought to the art a new and improved insulated concrete wall structure which overcomes the drawbacks of prior insulated concrete walls. In particular, the present concrete wall structure provides an insulated concrete wall which can be constructed in approximately the same amount of time as an uninsulated concrete wall using conventional wall forms.

While the invention has been described in connection with one or more embodiments, it will be understood that the invention is not limited to those embodiments. On the contrary, the invention covers all alternatives, modifications, and equivalents, as may be included within the spirit and scope of the appended claims.

What is claimed is:

1. An insulated concrete wall structure comprising:

a concrete wall having opposing wall surfaces;

a plurality of vertically and horizontally spaced wall ties contained within said concrete wall and extending between each of said wall surfaces;

an insulating panel located adjacent one of said wall surfaces and between said horizontally spaced wall ties; and at least one elongated retaining strip extending between adjacent vertically spaced wall ties, said insulating panel having edges retained by said retaining strips;

wherein each of said wall ties has a pair of notches formed therein proximate each end of said wall tie, each of said notches receiving one end of an elongated retaining strip such that an elongated retaining strip extends between each pair of adjacent vertically spaced wall ties.

2. The wall structure of claim 1 wherein said at least one elongated retaining strip extends between adjacent vertically spaced wall ties such that said elongated retaining strip is substantially parallel to said wall surface of said concrete wall.

3. The wall structure of claim 1 wherein at least one edge of said insulating panel has a groove formed therein receiving an elongated edge of said retaining strips.

4. The wall structure of claim 1 further comprising a second insulating panel located adjacent the other of said wall surfaces said second insulating panel having edges retained by said retaining strips.

5. An insulated concrete wall structure comprising:

a concrete wall having opposing wall surfaces;

a plurality of vertically and horizontally spaced wall ties contained within said concrete wall and extending between each of said wall surfaces;

an insulating panel located adjacent one of said wall surfaces and between said horizontally spaced wall ties; and at least one elongated retaining strip extending between adjacent vertically spaced wall ties, said insulating panel having edges retained by said retaining strips;

wherein each of said plurality of wall ties has breakaway portions formed therein such that upon breaking away an end portion of said wall tie, said wall tie is substantially flush with each of said wall surfaces.

6. An insulated concrete wall structure comprising:

a concrete wall having opposing wall surfaces;

a plurality of vertically and horizontally spaced wall ties contained within said concrete wall and extending between each of said wall surfaces;

an insulating panel located adjacent one of said wall surfaces and between said horizontally spaced wall ties; and at least one elongated retaining strip extending between adjacent vertically spaced wall ties, said insulating panel having edges retained by said retaining strips;

wherein each of said elongated retaining strips has at least one cut-out portion formed therein, each cut-out portion engaging one of said wall ties such that said elongated retaining strip is substantially parallel to said wall surfaces of said concrete wall.

7. The wall structure of claim 6 wherein each of said elongated retaining strips are greater than or equal in height to said insulating panels.

8. An insulated concrete wall structure comprising:

a concrete wall having opposing wall surfaces;

a plurality of vertically and horizontally spaced wall ties contained within said concrete wall and extending between each of said wall surfaces;

an insulating panel located adjacent one of said wall surfaces and between said horizontally spaced wall ties; and a plurality of elongated retaining strips, each of said retaining strips being located between adjacent vertically spaced wall ties, thereby forming at least two groups of horizontally spaced retaining strips, said insulating panel having edges retained by said respective groups of retaining strips;

wherein each of said plurality of wall ties has breakaway portions formed therein such that upon breaking away an end portion of said wall tie, said wall tie is substantially flush with each of said wall surfaces.

9. The wall structure of claim 8 wherein at least one edge of said insulating panel has a groove formed therein receiving an elongated edge of said retaining strips.

10. The wall structure of claim 8 further comprising a second insulating panel located adjacent the other of said wall surfaces, said second insulating panel having edges retained by said respective groups of retaining strips.

11. The wall structure of claim 10 wherein each of said retaining strips comprises two upstruck members forming a channel therebetween, said insulating panel and said second insulating panel each having edges retained within respective channels formed by respective groups of horizontally spaced retaining strips.

12. An insulated concrete wall structure comprising:

a concrete wall having opposing wall surfaces;

a plurality of vertically and horizontally spaced wall ties contained within said concrete wall and extending between each of said wall surfaces;

an insulating panel located adjacent one of said wall surfaces and between said horizontally spaced wall ties; and a plurality of elongated retaining strips, each of said retaining strips being located between adjacent vertically spaced wall ties, thereby forming at least two groups of horizontally spaced retaining strips, said insulating panel having edges retained by said respective groups of retaining strips;

wherein each of said retaining strips comprises two upstruck members forming a channel therebetween, said insulating panel having edges retained within respective channels formed by respective groups of horizontally spaced retaining strips.

* * * * *